US006577064B2

(12) United States Patent
Vos et al.

(10) Patent No.: US 6,577,064 B2
(45) Date of Patent: Jun. 10, 2003

(54) ELECTRIC HIGH-PRESSURE DISCHARGE LAMP

(75) Inventors: Theodorus Peterus Cornelis Maria Vos, Eindhoven (NL); Catharina Johanna Maria Daemen, Eindhoven (NL); Francis Jozef Clementina Vandyck, Turnhout (BE); Hendrik Anton Van Esveld, Eindhoven (NL); Johannes Jacobus Franciscus Geijtenbeek, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 90 days.

(21) Appl. No.: 09/854,381

(22) Filed: May 11, 2001

(65) Prior Publication Data

US 2002/0033672 A1 Mar. 21, 2002

(30) Foreign Application Priority Data

May 12, 2000 (EP) ..... 00201708

(51) Int. Cl.[7] ..... H01J 17/04; H01J 61/04

(52) U.S. Cl. ..... 313/631

(58) Field of Search ..... 313/631–634, 313/628, 362.1, 363.1, 639, 293, 606, 621

(56) References Cited

U.S. PATENT DOCUMENTS

| | | | | |
|---|---|---|---|---|
| 2,687,489 A | * | 8/1954 | Anderson, Jr. et al. | |
| 4,105,908 A | * | 8/1978 | Harding et al. | 313/628 |
| 4,210,840 A | * | 7/1980 | Bhalla | 313/346 R |
| 5,258,687 A | * | 11/1993 | Duggan et al. | 313/344 |
| 5,880,558 A | | 3/1999 | Bauer | 313/631 |
| 6,157,132 A | * | 12/2000 | Strok et al. | 313/491 |
| 6,307,321 B1 | * | 10/2001 | Honda et al. | 313/570 |

FOREIGN PATENT DOCUMENTS

| | | | | |
|---|---|---|---|---|
| JP | 55108159 A | * | 8/1980 | H01J/61/073 |
| JP | 55111055 | | 8/1980 | |
| JP | 03004441 | | 5/1989 | H01J/61/83 |

* cited by examiner

*Primary Examiner*—David Martin
*Assistant Examiner*—Thanh S. Phan
(74) *Attorney, Agent, or Firm*—Ernestine C. Bartlett

(57) ABSTRACT

The electric high-pressure discharge lamp has tungsten electrodes (2) in a light-transmitting lamp vessel (1) which is closed in a gastight manner. The electrodes (2) comprise an emitter, preferably in the form of an inner coiled-coil (14), which is loosely retained in a cavity (12) of a basket (6) of the electrode (2). The inner coil (14) acts as a non-oxidic emitter. The lamp retains its initial light output to a high degree throughout its life.

5 Claims, 1 Drawing Sheet

ELECTRIC HIGH-PRESSURE DISCHARGE LAMP

BACKGROUND OF THE INVENTION

The invention relates to an electric high-pressure discharge lamp comprising:

- a light-transmitting lamp vessel enclosing a discharge space in a gastight manner;
- an ionizable filling and a pair of electrodes with a non-oxidic emitter present in the discharge space, of which each electrode is connected to a current conductor which issues from the discharge space through the lamp vessel to the exterior and each electrode comprises an outer coil.

Such an electric lamp is known from JP-03-004441. The electrode of the known lamp comprises an electrode rod around and onto which an inner coil is directly wound. The outer coil is wound around the rod onto the inner coil. Thus the inner coil is enclosed between the electrode rod and the outer coil. Starting of the lamp is facilitated by this electrode construction. Heat generated by the electrode in the glow phase during ignition of the lamp can hardly escape from the outer coil, because the outer coil is comparatively well heat insulated from the electrode rod by the inner coil. During the ignition phase the outer coil is heated up to temperatures at which thermionic emission of tungsten occurs, i.e. the outer coil acts as a non-oxidic emitter. It is generally known that starting damage to the electrode occurs during the ignition phase which leads to sputtering and/or evaporation of electrode material. A disadvantage of the lamp is that sputtered/evaporated material from the electrode is deposited on the light-transmitting lamp vessel, leading to an increased blackening of the lamp vessel and consequently to a loss of light. The temperature reached by the outer coil is still comparatively low owing to the comparatively large mass of the outer coil and owing to the comparatively intensive physical contact between the outer coil and the inner coil and between the inner coil and the electrode rod. As the thermionic emission decreases with a decrease in the temperature, the thermionic emission of the outer coil is comparatively low, too. As a result, the lamp suffers from the additional disadvantage of a comparatively bad ignition behavior.

OBJECTS AND SUMMARY OF THE INVENTION

It is an object of the invention to provide an electric lamp of the type described in the opening paragraph in which the above disadvantages are counteracted.

According to the invention, this object is achieved in that the electric lamp is characterized in that the outer coil encloses a cavity in which the non-oxidic emitter is retained, and in that the non-oxidic emitter is substantially free from physical contact with the outer coil. The non-oxidic emitter preferably will be a metal object, for example a tungsten wire having thermionic emission at high temperatures, for example at temperatures of 2700 K or higher. Contrary to the known lamp, in which the outer coil reaches a high temperature during the ignition phase, it was found that the outer coil in the lamp of the invention remains comparatively cold whilst the non-oxidic emitter reaches a high temperature at which the thermionic emission takes place. The comparatively low temperature of the outer coil during the ignition phase has the effect that hardly any material is sputtered and/or evaporated from the outer coil onto the lamp vessel.

The high temperature of the emitter is due to its comparatively small mass in comparison with the comparatively large mass of the outer coil and to the fact that the emitter is retained in the cavity inside the outer coil in a heat-insulated manner. The heat-insulated trapping of the emitter is achieved in that it is substantially free from physical contact with the outer coil, for example in that it is attached to the outer coil at only one point. The sputtered and/or evaporated material from the emitter cannot reach the light-transmitting lamp vessel because the latter is shielded from the emitter by the outer coil. So the sputtered and/or evaporated material is deposited on the outer coil instead in the lamp of the invention. Blackening of the lamp vessel is reduced thereby and the lamp of the invention has an improved maintenance. The thermionic emission of the non-oxidic emitter during the ignition phase was found to be very good. Therefore, a separately supplied oxidic emitter, e.g. a thorium compound or a barium compound, was found to be unnecessary. The non-oxidic emitter has the advantages over an oxidic emitter that the risk of reaction of the emitter with the salt filling is decreased and that the non-oxidic emitter is comparatively cheap. The good thermionic emission of the electrode construction is probably due to the excellent heat insulation of the emitter from the outer coil, enabling the emitter to reach the comparatively high temperature. The lamp of the invention accordingly not only has a good maintenance but also a good ignition behavior. During stable operation of the lamp, the arc attaches at the outer coil and the emitter then is comparatively cool. The comparatively large mass and good thermal conduction of the outer coil cause the heat generated by the attachment of the arc to be conducted away to the lamp vessel comparatively well, and the outer coil will remain comparatively cool also during normal operation.

In an embodiment of the high-pressure electric discharge lamp, the non-oxidic emitter is an inner coil. It was found that the coil shape enables the inner coil to reach a higher temperature and thus an improved thermionic emission.

In a still further embodiment of the electric high pressure discharge lamp, the cavity formed by turns with a radius R of the outer coil has an end turn having a curvature with a radius R smaller than the radius R of the turns which form the cavity. The end turn acts as a lid, thereby improving the shielding of the light-transmitting lamp vessel from the emitter. As a result, the possibility of sputtered/evaporated material from the emitter depositing on the lamp vessel is further reduced and the maintenance of the lamp is further increased.

In a further embodiment of the electric high-pressure discharge lamp, the emitter is loosely retained in the cavity. It was found that the loosely held emitter enhances the heat insulation of the emitter from the outer coil. This enhanced heat insulation leads to a higher temperature of the emitter during the ignition phase, hence to an enhanced thermionic emission of the electrode. As a result, the starting behavior of the lamp is still further improved. A further increase in the temperature of the emitter and consequently in an enhanced thermionic emission of the electrode is obtained with a lamp in which the emitter has a coiled-coil shape.

The electrode may comprise an electrode rod onto which the outer coil, having an end part, is wound with its end part. The outer coil is thus connected to the current conductor via the electrode rod. The electrodes, i.e. the outer coil, the electrode rod and often the emitter, are made of metals having a high melting point, for example the electrodes may be made of tungsten, molybdenum, niobium or rhenium, or mixtures of these metals. The metals may contain up to a few per cents by mass of dopes, for example yttrium oxide or lanthanum oxide. The metals of the outer coil, the electrode rod, and the emitter of the electrodes may have the usual dopants and additives which control the crystal growth of the metal. For tungsten, additives such as potassium, aluminum, and silicon up to a total of, for example, 0.01% by weight of the tungsten are appropriate. Depending on the type of high-pressure metal halide discharge lamp, the electrodes may have various shapes and dimensions, e.g. a cup shape, or an open or a closed basket shape.

The electrodes may be arranged, for example, next to or opposite one another in the lamp vessel. The lamp vessel may be made of a glass with a high $SiO_2$ content, for example of quartz glass, i.e. glass with a $SiO_2$ content of at least 95% by weight. Alternatively, the lamp vessel may be made of a crystalline material such as, for example, polycrystalline aluminum oxide or sapphire. The lamp vessel may be accommodated in a closed outer envelope, if so desired.

A cup shaped electrode for use in discharge lamps is known from U.S. Pat. No. 5,880,558. The electrode has an inner coil having an intimate physical contact with the inner wall of the cup in that the inner coil is tightly arranged against the inner wall of the cup. The gaps between the windings of the inner coil and between the inner coil and the inner wall of the cup are filled with an oxidic emitter, i.e. barium compounds such as barium titanate, barium zirconate, barium cerate and barium hafnate.

BRIEF DESCRIPTION OF THE DRAWINGS

An embodiment of the lamp of the invention is elucidated in the drawing, in which.

DESCRIPTION OF THE PREFERRED EMBODIMENTS

Figure 1:
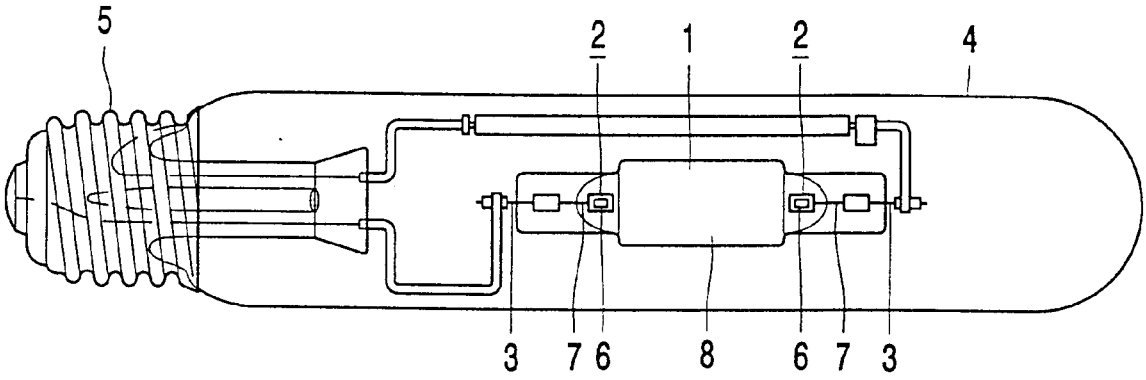
FIG. 1 is a high-pressure discharge lamp in side elevation.

In FIG. 1 the high-pressure metal halide discharge lamp is provided with a light-transmitting lamp vessel 1, made of quartz glass in the drawing, which encloses a discharge space 8 in a gastight manner. The lamp vessel contains an ionizable filling with rare gas and metal halide. Tungsten electrodes 2 are arranged in the lamp vessel and connected to current conductors 3, made of molybdenum in the Figure, which issue to the exterior through the lamp vessel. The electrodes 2 each comprise an electrode rod 7 and a basket 6. The lamp shown has a quartz glass outer envelope 4 which supports a lamp cap 5

Figure 2:
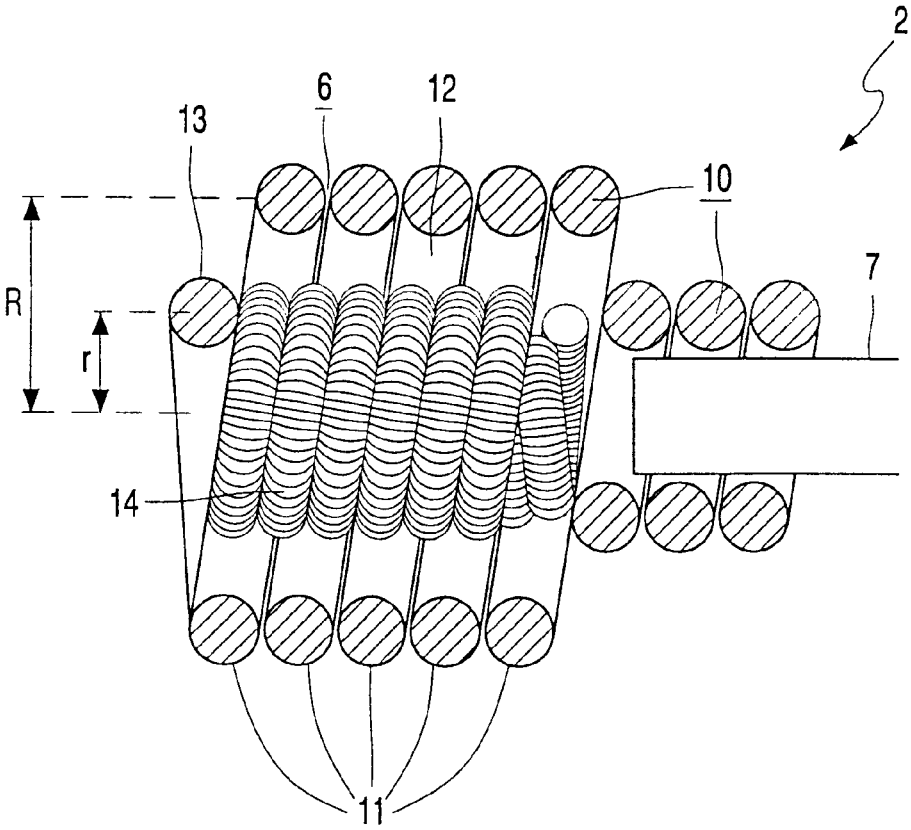
FIG. 2 is a detailed view of one of the electrodes of the lamp of FIG. 1.

FIG. 2 shows one of the electrodes 2; which has an outer coil 10 attached to the electrode rod 7. A plurality of turns 11 of the outer coil 10, having a radius R, form the basket 6. The basket 6 encloses a cavity 12. The electrode rod 7 does not extend into the cavity 12. The outer coil 10 has an end turn 13 with a curvature of a small radius R which acts as a lid for the cavity 12 and by means of which an inner coil 14 is retained in the cavity 12. The inner coil 14, having a coiled-coil shape, is substantially free from physical contact with the outer coil 10 in that the inner coil 14 is loosely retained in the cavity 12.

The lamp shown in FIG. 1 consumes a power of 400 W. Each lamp had 50 mg Neon as a rare gas, 43 mg mercury and 34 mg salt mixture of sodium iodide, thallium iodide, and indium iodide as the ionizable filling. The lamp had electrodes selected from those mentioned in Table 1. Lamps according to the invention and a lamp having $ThO_2$-pellet as an oxidic emitter, used as a reference lamp, were operated for 3500 h and their glow time and lumens were measured, as was their lumen maintenance (maint.). A few characteristics are given in Table 1. The single coil is made of tungsten wire with a diameter of 240 $\mu$m, the coil having a length of about 2.83 mm and a width of about 1.65 mm. The coiled-coil is a twice wound tungsten wire with a diameter of 66 $\mu$m, the coil having a length of about 2.4 mm and a width of about 1.8 mm.

TABLE 1

| Electrode construction | Lumens At 0 hr | Maint.(%) 100 h | Maint.(%) 1000 h | Maint.(%) 3500 h | Glow time (msec) |
|---|---|---|---|---|---|
| W – basket + $ThO_2$ – pellet (reference) | 31900 | 97 | 92 | 89 | 223 |
| W – basket + W inner single coil | 32400 | 97 | 90 | 85 | 396 |
| W – basket + W inner double coil | 32400 | 97 | 92 | 88 | 238 |
| Empty W – basket | 33300 | 92 | 86 | 78* | 611 |

*measured after 2000 of operation instead of 3500 hours.

It is apparent from Table 1 that the lamps according to the invention show a lumen output, maintenance and a glow time comparable to those of the reference lamp having electrodes with thorium oxide as an emitter. The lamp of the invention with a coiled-coil inside the tungsten basket has a practically equally high initial lumen output, an equally good lumen maintenance and an equally short glow time as the reference lamp. The empty basket electrode gives an impression of the significantly longer glow time during the ignition phase when an emitter is omitted. A long glow time increases the sputtering and/or evaporation of electrode material, which in its turn negatively influences the maintenance of the lamp. The bad maintenance of the lamp with the empty basket electrode is apparent from Table 1.

What is claimed is:

1. An electric high-pressure discharge lamp comprising:

a light-transmitting lamp vessel enclosing a discharge space in a gastight manner;

an ionizable filling and a pair of electrodes with a non-oxidic emitter present in the discharge space, of which each electrode is connected to a current conductor which issues from the discharge space through the lamp vessel to the exterior and each electrode comprises an outer coil, characterized in that the outer coil encloses a cavity in which the non-oxidic emitter is retained, and in that the non-oxidic emitter is substantially free from physical contact with the outer coil.

2. An electric high-pressure discharge lamp according to claim 1, characterized in that the non-oxidic emitter is a coil.

3. An electric high-pressure discharge lamp according to claim 2, characterized in that the inner coil has a coiled-coil shape.

4. An electric high-pressure discharge lamp according to claim 1, characterized in that the cavity formed by turns with a radius R of the outer coil has an end turn having a curvature with a radius R smaller than the radius R of the turns which form the cavity.

5. An electric high-pressure discharge lamp according to claim 4, characterized in that the non-oxidic emitter is loosely retained.

* * * * *